United States Patent [19]

Braski et al.

[11] 4,221,610

[45] Sep. 9, 1980

[54] METHOD FOR HOMOGENIZING ALLOYS SUSCEPTIBLE TO THE FORMATION OF CARBIDE STRINGERS AND ALLOYS PREPARED THEREBY

[75] Inventors: David N. Braski, Oak Ridge; James M. Leitnaker, Kingston, both of Tenn.

[73] Assignee: The United States of America as represented by the United States Department of Energy, Washington, D.C.

[21] Appl. No.: 880,919

[22] Filed: Feb. 24, 1978

[51] Int. Cl.[2] ..... C22C 19/00; C22F 1/10

[52] U.S. Cl. ..... 148/11.5 N; 148/12.7 N; 148/13.1; 148/162

[58] Field of Search ..... 148/13 R, 13.1, 135, 148/136, 142, 32, 11.5 N, 12 E, 12.7 N, 162; 75/128 R, 128 T, 128 W, 170, 171

[56] References Cited

U.S. PATENT DOCUMENTS

| | | | |
|---|---|---|---|
| 3,310,440 | 3/1967 | Piearcey | 148/13 R |
| 3,384,476 | 5/1968 | Egnell | 75/128 R |
| 3,563,813 | 2/1971 | Webster | 148/135 |
| 3,645,799 | 2/1972 | Gove et al. | 148/13 |
| 3,753,790 | 8/1973 | Walker et al. | 148/13 R |
| 3,798,075 | 3/1974 | Bendel | 148/12 E |
| 3,826,689 | 7/1974 | Ohta et al. | 148/12 E |

OTHER PUBLICATIONS

Braski, D. N., Lietnaker, J. M., "Production of Homogeneous Titanium-Hastelloy N Alloys", ORNL/T-M-5697, 2/1977.

*Primary Examiner*—L. Dewayne Rutledge
*Assistant Examiner*—Peter K. Skiff
*Attorney, Agent, or Firm*—James E. Denny; Stephen D. Hamel; Allen H. Uzzell

[57] ABSTRACT

A novel fabrication procedure prevents or eliminates the reprecipitation of segregated metal carbides such as stringers in Ti-modified Hastelloy N and stainless steels to provide a novel alloy having carbides uniformly dispersed throughout the matrix. The fabrication procedure is applicable to other alloys prone to the formation of carbide stringers. The process comprises first annealing the alloy at a temperature above the single phase temperature for sufficient time to completely dissolve carbides and then annealing the single phase alloy for an additional time to prevent the formation of carbide stringers upon subsequent aging or thermomechanical treatment.

6 Claims, 6 Drawing Figures

METHOD FOR HOMOGENIZING ALLOYS SUSCEPTIBLE TO THE FORMATION OF CARBIDE STRINGERS AND ALLOYS PREPARED THEREBY

BACKGROUND OF THE INVENTION

This invention was made in the course of, or under, a contract with the United States Department of Energy. This invention relates to the homogenization of alloys and more specifically to the homogenization of alloys prone to the formation of precipitate stringers.

In the prior art a number of alloys have been developed consisting of matrix metal and a precipitated phase, such as metal carbide, in the matrix. The precipitate generally serves to prevent grain growth and to increase strength and hardness. Generally, precipitation hardened alloys are fabricated by casting an ingot having a desired composition and heating the ingot to a temperature in the single phase region to dissolve precipitated phases. This procedure is normally termed "solution annealing". The annealed alloy is then cooled either by natural cooling at ambient conditions or by quenching. A cooling process results in a supersaturated solid solution matrix phase, typically containing a relatively small amount of precipitated particles. The amount of precipitate is generally a function of the cooling rate. Upon aging at some elevated temperature, e.g. about ½ the Kelvin single phase temperature, additional precipitation occurs. The precipitate size will normally depend upon the aging temperature and time and, in some cases, also on previous working conditions. By appropriate control of the reprecipitation conditions, those skilled in the metallurgical arts can achieve a wide range of properties in the alloy. Typical precipitation-hardened alloys and their fabrication are described in commonly assigned U.S. Pat. Nos. 3,640,740; 3,723,193; 2,921,850; 3,576,662; and 3,804,680.

In order to achieve the most uniform properties it is generally desirable that precipitated phases be uniformly dispersed throughout an alloy rather than being segregated as clusters or stringers. In some alloy systems, notably titanium or niobium-modified nickel or iron-based alloys, precipitation of the metal carbides is inhomogeneous. Carbides that were segregated in the original casting precipitate out in segregated patches. Where the material is fabricated, the patches are extended into long lines or "stringers" which are parallel to the working direction. For purposes of this invention, the terms "homogeneous" and "uniformly dispersed" refer to metal carbides dispersed throughout the matrix and having no local, i.e. 20 micron cube, concentration of precipitated carbides more than 10% above the overall concentration of precipitated carbides in the alloy. Segregated metal carbides are non-uniformly dispersed carbides and include carbides precipitated in patches or clusters, extended into stringers, or reprecipitated as stringers. These carbide stringers are often deleterious during subsequent working operations because they tend to impart a directionality to the mechanical properties of the worked alloy. This directionality can sometimes be used to advantage (e.g. in forging) but in most cases it is not useful and can cause cracking during fabrication. In nuclear applications, the non-uniform distribution of carbides in such alloys was believed to cause a large variation in post-irradiation creep properties.

Stringers are not easy to remove from the microstructure. Solution annealing to dissolve the precipitate stringers does not permanently remove them; the stringers reappearing again upon aging at elevated temperatures. This reappearance of carbides back into stringers was termed a "memory effect". The implications of stringer formation in alloys have not been thoroughly appreciated in the prior art. The effects of stringers on important properties of the alloy have been ignored. There was no effective way of eliminating the memory effect in alloys in which stringers were reprecipitated after dissolution.

SUMMARY OF THE INVENTION

It is an object of this invention to provide a method for uniformly dispersing the carbides in alloys prone to reprecipitation of segregated carbides. A further objective is to apply this method to adjust the compositions of certain stainless steels and nickel-based alloys such that stringers will not form when using ordinary heat treatments. These and other objects are achieved in a method of fabricating alloys having compositions susceptible to the formation of stringers. The method comprises (a) casting an alloy having the desired composition and containing a segregated metal carbide phase; (b) after step (a) annealing said alloy having a segregated carbide phase at a temperature above the single phase temperature for said composition for a time sufficient to dissolve said segregated metal carbides; (c) after step (b) further annealing the resulting single phase alloy at a temperature above the single phase temperature for a sufficient time to prevent precipitation of segregated metal carbides upon subsequent aging or thermomechanical treatment. After step (c) the alloy can be aged at a temperature below the single phase temperature to precipitate metal carbide particles as a uniform dispersion within said alloy.

In its composition aspects this invention comprises either improved stainless steels comprising by weight 13–15% Cr, 13–15% Ni, 0–1.1% Mo, 0–1% Si, 0.025–0.05% C, 0.15–0.3% Ti (6×C) and the remainder Fe; or an improved Ti-modified Hastelloy N comprising by weight 12 to 16% Mo, 5 to 9% Cr, 0 to 3% Fe, 0 to 3% Mn, 1 to 2% Ti, 0.02 to 0.08% C and the balance Ni, said alloy having been annealed at a temperature above its single phase temperature for sufficient time to prevent the reprecipitation of segregated metal carbides upon subsequent aging or thermomechanical treatment. The alloy can be either in its solution-annealed condition or it can consist of a matrix containing metal carbide particles substantially uniformly dispersed throughout said matrix.

DETAILED DESCRIPTION

Figure 1:
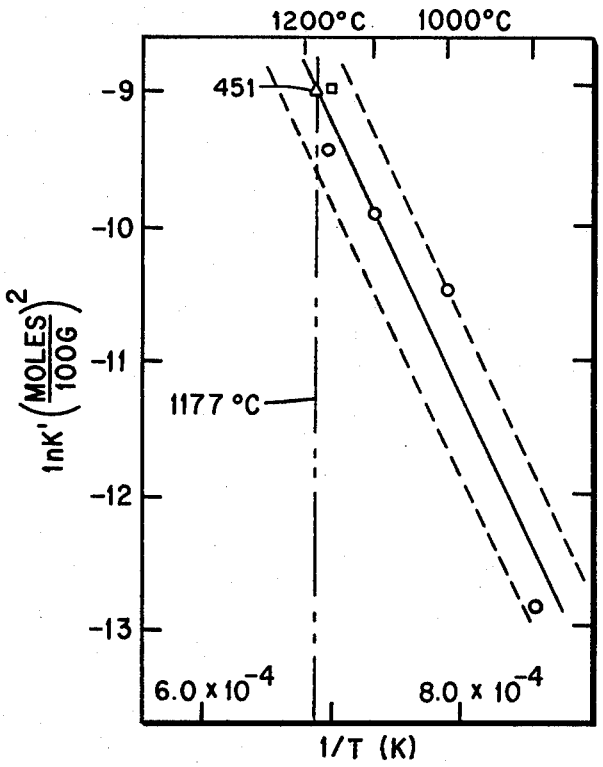
FIG. 1 is a graph of the natural logarithm of K′ for nickel based Hastelloy N as a function of 1/T.

One aspect of this invention is the discovery of the source of the problem of stringer formation in Ti-modified Hastelloy N and its associated memory effect. Ti-modified Hastelloy N having a composition by weight of 13 to 15% Mo, 6 to 8% Cr, 0 to 2% Fe, 0 to 2% Mn, 1.8 to 2.2% Ti, 0.05 to 0.08% C and the balance Ni is prone to the formation of carbide stringers even after "solution annealing" at 1177° C. (2150° F.). The preferred composition by weight is 14% Mo, 7% Cr, 0.5% Mn, 2% Ti and about 0.06% C with the remainder Ni. The purpose of Ti is two-fold. The Ti eliminates the formation of massive $M_{12}C$ (eta phase) carbides which are embrittling, by the formation of $MC_x$ carbides, which are strengthening. Enough Ti must be present to completely react with the carbon. The precipitated carbide phase has been determined to be a mixed metal carbide (MC) containing both titanium carbide and about 50% Mo which is believed to be present as a solid solution of TiC and $Mo_3C_2$. In the prior art the 1177° C. maximum temperature for treating Ti-modified Hastelloy N was chosen because a one-hour anneal at 1177° C. provided an acceptable grain size. Typically, the one-hour anneal at 1177° C. was sufficient to dissolve many or most of the carbides depending on the alloy's history. Upon subsequent heat treatment, i.e. aging, dissolved carbides precipitated into essentially the same stringer configurations and locations as were originally present. Stringers had been observed in specimens which had been previously annealed, irradiated in a reactor and then creep treated. These stringers were likely responsible for wide variations in post-irradiation creep properties.

It has been found that by appropriate control of processing parameters stringer formation can be completely prevented, or if stringers have appeared they can be permanently eliminated from the alloy. According to this invention, it has been found that the reprecipitation of segregated metal carbides or stringers is related to both the Ti and C content of the alloy and the annealing conditions. By prolonged annealing at a temperature in the single phase region, first for a time sufficient to completely dissolve precipitates and then for an additional time to disperse the solute elements, the precipitation of stringers upon subsequent heat treatment will be eliminated. It is believed that the additional anneal causes dispersion of metallic elements from the site of prior precipitation. Carbon diffuses about 4 orders of magnitude more rapidly than titanium or molybdenum in nickel-based alloys. It is the relatively slow diffusion of Ti and Mo which accounts for the memory effects even where solution annealing was performed to entirely place the precipitate in the solution.

It has been found according to this invention that the formation of this MC precipitate can be adequately described by the constant $K' = [Ti] \times [C]$. This constant is treated essentially as a solubility product and is dependent upon the temperature. Accordingly, this constant is useful for determining the single phase temperature for a particular alloy in the system. By knowing the relationship of K' to the temperature, the minimum single phase temperature $T_o$ for a particular Ti and C concentration can be determined.

K' for a system is determined empirically by the following method: an alloy having known composition, including Ti and C content, is annealed at a temperature which is insufficient to completely dissolve all the carbide precipitate. The presence of carbide precipitate can be easily determined by electron microscopy. The annealed alloy is then quenched and the precipitate is extracted and analyzed quantitatively. The amount of Ti and C in solution can then be determined by the difference between what was originally present and what was precipitated. A product of the concentrations of Ti and C in solution gives a value of K' for that annealing temperature. By similar methods K' can be determined for a range of annealing temperatures. The variation of K' as a function of temperature can then be used to determine the minimum temperature adequate for dissolving the precipitate (minimum single phase temperature).

FIG. 1 is a graph of ln K', ln [Ti]×[C], for Ti-modified Hastelloy N alloy composition. The dotted lines indicate the uncertainty zones in computing the values of K'. By locating the ln [Ti]×[C] product on the solid line and moving horizontally to the left to a point beyond the dotted diagonal uncertaintly line one arrives at a value of 1/T which corresponds to the safe single phase temperature. While all that is required according to this invention is that the alloy be annealed at a temperature above its single phase temperature to both dissolve carbides and disperse carbide forming solutes, it is recommended that the anneals be performed above the safe single phase temperature to ensure against possible analytical uncertainty. The safe temperature line of FIG. 1 and its linear extrapolations represent the expected safe single phase temperature of an alloy consisting essentially of by weight 12–16% Mo, 5–9% Cr, 0 to 3% Fe, 0 to 3% Mn, 1 to 2% Ti and 0.02–0.08% C. The carbide formation is slightly affected by Cr and Mo concentrations and the equation of the line will be expected to vary in a continuous manner for composition beyond these limits. By "consisting essentially of" it is meant excluding amounts of other carbide forming elements which would prevent the complete dissolution of carbides at the safe single phase temperature corresponding to the Ti and C content. The equation of the straight line is $$\ln K'\left(\frac{\text{moles}}{100\text{g}}\right)^2 = 4.705 - \frac{1.9886 \times 10^4}{T(K)} \quad (1)$$

The length of annealing time needed to dissolve carbide precipitate in alloy is a function of the temperature above the single phase temperature and of the size of the article. The higher the annealing temperature above the single phase temperature the shorter time is needed to solubilize the carbide phase. The larger physical size of the alloy, the longer time needed to dissolve the carbide phase due to uneven heating and cooling effects. Once the precipitate phase is in solution, the additional annealing time to eliminate the memory effect is no longer dependent upon the size of the article, so long as no large temperature gradients exist. This anneal after dissolution can be at the same temperature or at a higher temperature than the solution anneal. The exact time-temperature relationship will depend upon the extent to which carbides are segregated. Generally, however, at least about three-quarters hour following dissolution is needed at a temperature less than about 50° C. above the minimum single phase temperature. At high temperatures, more than about 50° C. above the single phase temperature, at least one-half hour is needed.

The effects of the annealing conditions upon the formation of stringers are demonstrated in the following examples. Table 1 contains the composition of several alloys fabricated to demonstrate this invention. Also given is the ln K', the $T_o$ according to equation (1) and the minimum safe $T_o$. The alloys of Table 1 have compositions lying within the range desired for nuclear applications and it will be seen that the relationship of Equation (1) and FIG. 1 are valid for these compositions. The alloys were arc melted under argon in a tungsten electrode arc-melter at a pressure 20 torr. The amount of chromium in the original charge was about 0.5% higher than specified for the alloy to allow for evaporation losses. A zirconium charge was melted in the apparatus just prior to melting of the alloy to getter residual gases from the environment. Each alloy was melted six times with a total melt time of less than five minutes. Finally the alloy button was remelted and drop cast into a water-cooled cylindrical copper mold.

TABLE 1

| | Alloy compositions (wt.%) | | | | |
|---|---|---|---|---|---|
| | Alloy | | | | |
| Element | 452 | 451 | 450 | 503 | 114 |
| Mo | 13.5 | 13.5 | 13.6 | 12.95 | 12.03 |
| Cr | 7.7 | 8.2 | 8.1 | 6.96 | 7.24 |
| Ti | 1.8 | 1.9 | 2.1 | 1.94 | 1.96 |
| C | 0.055 | 0.038 | 0.062 | 0.06 | 0.05 |
| Mn | <0.1 | <0.1 | <0.1 | <0.1 | <0.1 |
| Nb | <0.1 | <0.1 | <0.1 | <0.1 | <0.1 |
| Fe | ~0.3 | ~0.3 | ~0.3 | ~0.3 | ~0.3 |
| Ni | Balance | Balance | Balance | Balance | Balance |
| lnK' | −8.667 | −8.982 | −8.393 | −8.505 | −8.677 |
| $T_o$, °C.* | 1214 | 1180 | 1245 | 1232 | 1209 |
| Safe $T_o$ | 1285 | 1250 | 1320 | 1305 | 1280 |

*From Equation (1)

The alloys were cast into 6 inch long by 1 inch diameter ingots and converted into ¼ inch diameter rods by swaging with intermediate anneals. The schedules used to fabricate the alloys 450, 451 and 452 are listed in Table 2.

ethyl alcohol at room temperature. A DC potential of 1.5 volts was maintained between the sample (anode) and a platinum cathode. The carbides were separated from the solution by centrifuging and then were dried for at least 30 minutes in a vacuum desiccator. Extracted carbides were analyzed by x-ray diffraction by first combining them with a drop of ethyl alcohol and depositing the slurry on a polished single crystal substrate of silicon. The silicon crystal was cut so that the surface normal was about 7° off the (111) pole and thus provided a low background substrate for x-ray diffraction analysis. A graphite monochromator in the diffracted beam further reduced background by eliminating fluorescent radiation. Data were collected on paper tapes by a teletype readout and the x-ray profiles were plotted using a Calcomp Plotter. The extracted carbides were also analyzed qualitatively by x-ray fluorescence in a General Electric Diffractometer that had been converted for fluorescence analysis. Alloy 452, which contained 0.055% carbon, demonstrated carbide stringers after the swaging operation. After one hour annealing at 1177° C. most of the carbides were dissolved into the matrix phase. Recrystallization and growth of the cold worked structure had also taken place. After aging for 160 hours at 750° C. (corresponding to an upper operating temperature in a molten salt reactor) metal carbide precipitated from the matrix. The carbide precipitation occurred predominantly in the same areas where it existed after swaging and in the form of stringers, thereby revealing the memory effect. As seen from Table 1, alloy 452 had a titanium and carbon composition which was not completely soluble at 1177° C., the annealing temperature practiced in the prior art.

Alloy 451 had a lower composition of carbon. Alloy 451 nevertheless showed a small amount of carbide stringers present after a fabrication procedure including a one hour anneal at 1177° C. The temperature was substantially sufficient to put the carbides into solution, however the time was apparently insufficient. Upon a subsequent one hour anneal at 1177° C. nearly all of the carbides had been dissolved. Moreover, carbide stringers did not reappear after aging at 760° C. for 233 hours. Carbide instead precipitated on grain boundaries, twin boundaries and on (111) matrix planes. Annealing temperatures above a $T_o$ of about 1205° C. or a safe $T_o$ of about 1280° C. are required according to this invention for Ti-modified Hastelloy N consisting essentially of

TABLE 2

| Step No. | Fabrication process | Diam (in.) | Reduction of area (%) | 451 (0.038 wt. % C.) | 452 (0.055 wt. % C.) | 450 (0.062 wt. % C.) |
|---|---|---|---|---|---|---|
| 1 | Arc-drop cast | 1.00 | | | | |
| 2 | Hot swage at 1177° C. | | | | | |
| | Pass 1 | 0.87 | 24.3 | 15-min reheat between passes | 30-min. reheat between passes | Canned in 316 SS: 15-min reheat between passes |
| | Pass 2 | 0.74 | 27.7 | | | |
| | Pass 3 | 0.64 | 25.2 | | | |
| | Pass 4 | 0.54 | 28.8 | | | |
| | Pass 5 | 0.49 | 17.7 | | | |
| | Pass 6 | 0.43 | 22.9 | | | |
| 3 | Homogenizing anneal | | | 1 hr at 1177° C. (air cooled) | 2 hr at 1177° C. (air cooled) | 1 hr at 1260° C.(air cooled) + 1 hr at 1300° C. (water quenched) |
| 4 | Cold swage (room temperature) | 0.34 | 37.5 | | | |
| 5 | Intermediate anneal | | | 1 hr at 1177° C. | 1 hr at 1177° C. | 15 min. at 1177° C. |
| 6 | Cold swage (room temperature) | 0.25 | 45.9 | | | |

Alloy 450 which was annealed at a higher temperature, was canned in a type 316 stainless steel tube, having a 0.120 inch wall, to minimize decarburization at annealing temperatures. Protection against decarbonization is required only for small samples having high surface area/volume ratios. Samples were cut from the fabricated rods for metallographic examination. Carbide particles were extracted from samples by electrochemically dissolving the matrix material in a solution of 10 milliliters of concentrated HCl and 90 milliliters of 13–15% Mo, 6–8% Cr, 0–2% Fe, 0–2% Mn, 1.8–2.2% Ti, 0.05–0.08% C and the balance Ni.

Figure 2:
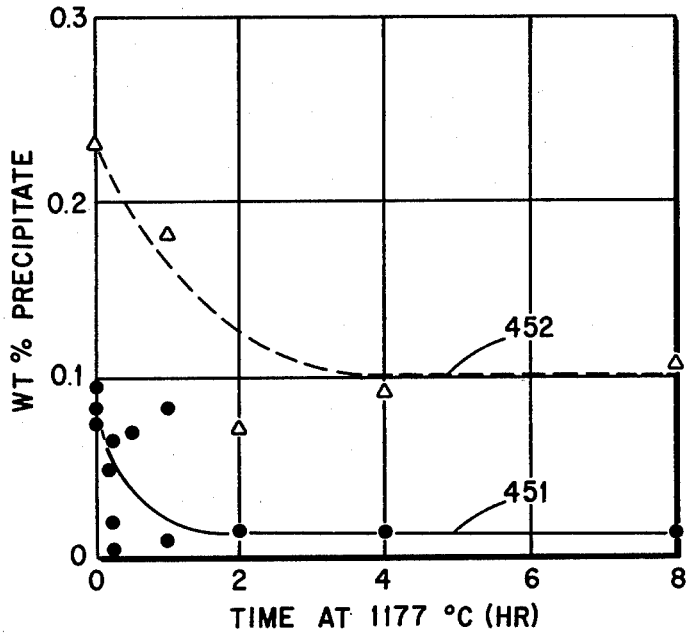
FIG. 2 is a graph of the amount of MC precipitate present in Ti-modified Hastelloy N as a function of time.

FIG. 2 demonstrates the rate of carbide dissolution in alloy 451 compared with alloy 452, which has a higher carbon content. The data was obtained by annealing samples of each alloy after fabrication according to Table 2 at 1177° C. in argon for different times up to 8 hours and then cooling them in an argon stream. Electrochemical extraction techniques as earlier described were used to measure the quantity of undissolved carbide left in the microstructure. As shown in FIG. 2, complete solution is achieved more rapidly in alloy 451, presumably because of the lower carbon content. In the case of 451 only about one hour was needed to dissolve the precipitate remaining in the alloy after the fabrication technique. After about one hour essentially all of the carbides had been dissolved in the matrix. Small amounts of carbides remaining had precipitated during cooling. For alloy 452 dissolution did not cease until after more than three hours. It might be noted that according to our invention, even though all of the carbides would not dissolve at 1177° C. in alloy 452, additional annealing after the cessation of dissolution will nevertheless prevent reprecipitation as stringers. Accordingly, it can be seen that some measure of improvement in homogeneity can be obtained at annealing temperatures below $T_o$ by sufficient annealing to disperse dissolved carbide forming elements. Of course undissolved precipitate may tend to remain as stringers, but that which reprecipitates upon aging will precipitate in a uniform dispersion.

To investigate the effect of temperature changes, samples of alloy 452 after the fabrication schedule of Table 2 were annealed for one hour at 1177°, 1204°, 1260°, and 1300° C., respectively, and then aged at 760° C. for 160 hours. The anneals at 1177° C. and 1204° C. did not eliminate the memory effect and many carbides precipitated in areas originally containing stringers, however the anneals at 1260° C. and at 1300° C. were successful in removing the stringers. The microstructure upon aging contained a reasonably uniform dispersion of metal carbide within the grains with some metal carbide particles also observed in the grain boundary. Although much of the precipitate in the sample annealed at 1204° C. lay along the (111) planes, many precipitates were still concentrated in the original stringer areas. This observation indicated that while most of the carbides had been dissolved at 1204° C. the one hour annealing time was not sufficient to permit adequate dispersion of the dissolved carbide forming elements throughout the matrix.

Alloy 450 was fabricated using a higher temperature anneal after the hot working steps. The hot swaging was conducted at 1177° C. but the reheat times were held at 15 minutes to minimize grain growth. It is known that in Ti-modified Hastelloy N alloys that MC particles effectively inhibit grain growth and areas lacking in carbides experience more grain growth. Alloy 450 experienced sufficient annealing at a temperature above its single phase temperature to prevent the subsequent formation of carbide stringers.

Figure 3:
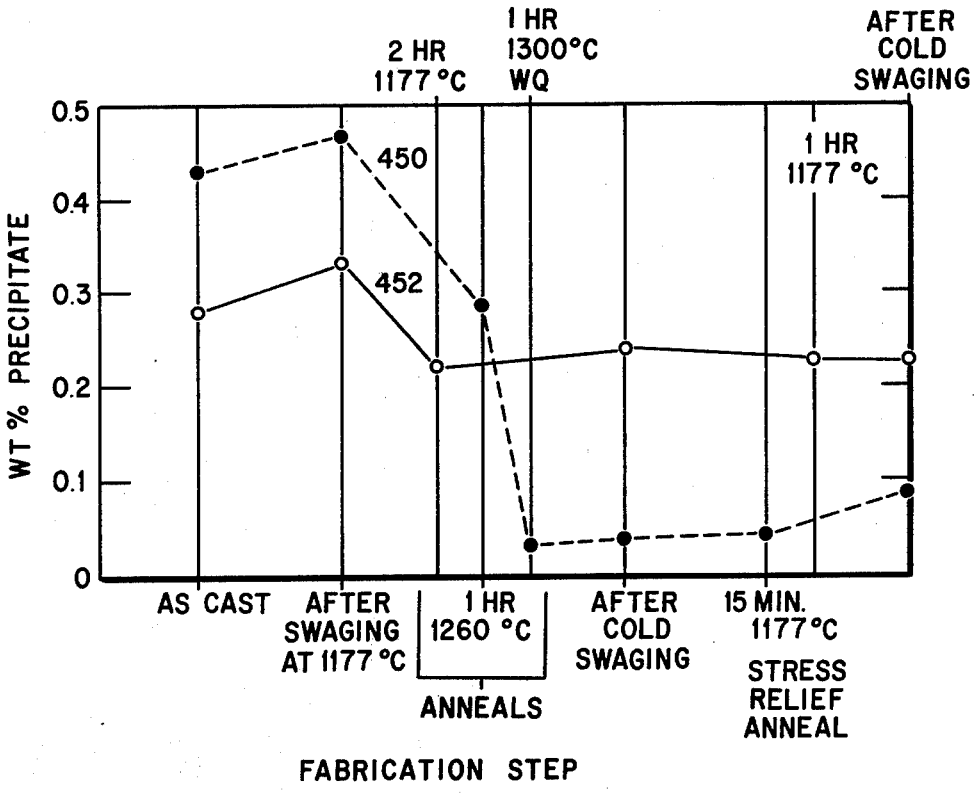
FIG. 3 is a graph of the amount of MC precipitate present in Ti-modified Hastelloy N as a function of fabrication conditions.

According to this invention it is generally desirable that high temperature anneals to remove stringers be performed as early in the fabrication procedure as possible to prevent excess grain growth. It is also desirable that hot working steps all be performed at temperatures above the minimum single phase temperature of the alloy in order to enhance, whenever possible, the dispersion of metal carbide forming elements throughout the matrix. FIG. 3 compares the weight percent precipitate found in alloys 450 and alloys 452 after the various treatment steps described in Table II. As seen alloy 450 which contained slightly more carbon than 452 initially contained greater quantities of MC precipitate. Some precipitation of MC occurred during the hot swaging of both alloys. Alloy 450 was water quenched after the 1300° C. anneal, and contained very little precipitate. 1300° C. was above $T_o$ as calculated from Equation (1) and within about 20° C. of the safe single phase temperature of this alloy. Annealing at 1300° C. continued for about 45 minutes after dissolution had ceased. The solution annealing steps for each alloy were critical for reducing the amount of precipitate. As seen the two stage solution annealing step for alloy 450 at temperatures near the safe single phase temperature provided a much lower amount of precipitate. In alloy 452 the amount of precipitate after annealing remained substantially unchanged indicating that carbide dissolution had ceased.

Though we have demonstrated the successful removal of stringers, it is preferable that the alloy be fabricated in such a manner as to prevent stringer formation from occurring in the first place, thereby eliminating the memory effect altogether. This is accomplished by the following fabrication procedure which we regard as our preferred process. The cast alloy is rapidly water quenched to room temperature and then solution annealed at a temperature above the minimum single phase temperature for a time sufficient to both dissolve any precipitate which may be present and to disperse dissolved material sufficiently to eliminate the memory effect upon subsequent precipitation. This will normally require at least two hours for alloys having a single phase temperature above about 1200° C. All hot working fabrication steps and stress relief anneals should then be carried out at temperatures at or above the safe single phase temperature for the alloy. This will prevent stringer formation in the event the solution annealing time had not been sufficient. Final anneals to achieve the optimum grain growth can then be performed either above or below the safe single phase temperature. It has been found that for alloy 450 the optimum final anneal at 1177° C. is for two hours. This anneal provides the maximum creep ductility for irradiated samples.

One of the proposed applications of nickel-based alloy Hastelloy N is in molten salt nuclear reactors where the alloy would be exposed to tellurium vapor at high temperatures about 700° C. Table III compares crack data collected from three Hastelloy N alloys that were exposed to tellurium vapor at 700° C. and subsequently tensile tested at room temperature.

TABLE 3

| Alloy heat No. | Cracks/in. | Preliminary results of tellurium corrosion tests (250 hr in Te vapor at 700° C., followed by tensile testing at room temperature) Average depth (μm) | Maximum depth (μm) | Yield Strength (ksi) | Ultimate tensile strength (ksi) | Uniform elongation (%) |
|---|---|---|---|---|---|---|
| 5065 | 240 | 44.5 | 89.9 | 52.5 | 125.7 | 38.5 |
| 114 | 225 | 56.8 | 120.0 | 48.6 | 111.2 | 49.9 |
| 450 | 127 | 21.9 | 58.4 | 50.1 | 112.1 | 55.7 |

Alloy 450 specimens had fewer cracks per unit length and the cracks were shallower than either the unmodified (5065) or titanium-modified Hastelloy N (114), both of which contained stringers. Although the strengths of alloy 450 were about the same as alloys 5065 and 114, the ductility of alloy 450 was greater. Accordingly, it is seen that the homogeneous alloy of this invention containing precipitates uniformly dispersed throughout the matrix is superior to similar alloys containing stringers.

Figure 4:
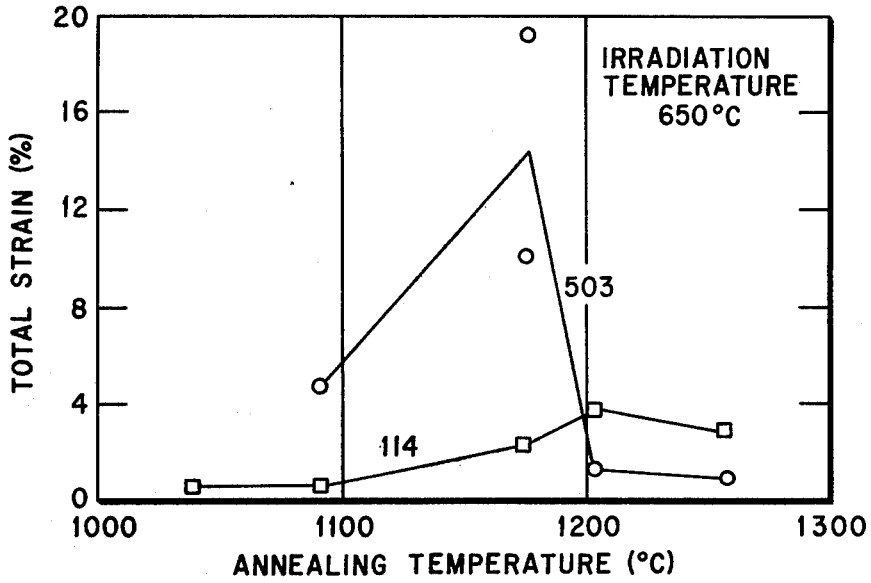
FIG. 4 is a graph of total strain in creep ductility tests of irradiated samples prepared at various annealing temperatures.
Figure 5:
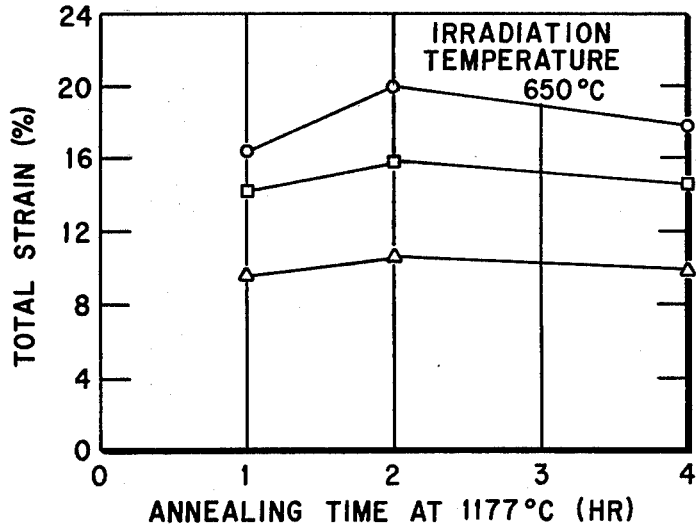
FIG. 5 is a graph of total strain of an alloy prepared according to the method of this invention.

FIGS. 4 and 5 demonstrate the homogeneity and improved radiation resistance of alloys of this invention. Alloys 114 and 503 (Table 1) had the same nominal composition of alloy 450 and were given the same fabrication schedule of alloy 450 except that the homogenizing anneal was performed at 1177° C. for 1 hour. Creep specimens were irradiated in the Oak Ridge Research Reactor to a total fluence of $3\times10^{20}$ neutrons/cm$^2$, at 650° C., which required about 1000 hours. The specimens were creep tested after irradiation and the results are shown in FIG. 4. The very large difference in creep properties of alloys of supposedly the same composition and annealing temperature was due to non-uniform carbide distribution, including stringers as evidenced by light microscope examination. The marked variation in creep properties was maximized for the prior art annealing temperature of 1177° C. FIG. 5 depicts the creep ductility of alloy 450 similarly irradiated for 1000 hours to $3\times10^{20}$ neutrons/cm$^2$ at various temperatures. Since the alloy contained few if any stringers prior to the 1177° C. anneal, the data indicates the desired grain growth can be achieved by cold working the alloy of this invention followed by subsequent anneal, below the minimum single phase temperature. As seen, 2 hours at 1177° C. provides the best creep behavior.

In summary, it has been shown that a homogeneous titanium-modified Hastelloy N alloy containing more than 0.05 wt.% C and 1.8 wt.% Ti can be produced only by increasing the solution annealing temperature to about 1205° C. The annealing should be carried out first to dissolve carbide particles and for about an additional time to sufficiently distribute carbide-forming elements to prevent the memory effect. Of course the dimensions of the material being treated must be taken into account which reflects the cooling behavior and the time that substantial fractions of the alloy experience carbide precipitation temperatures.

While the concept of this invention has been demonstrated with Ti-modified Hastelloy N, those of ordinary skill in the metallurgical arts will recognize that the general concepts and procedures described herein would be applicable for all metal carbide-strengthened alloys prone to the formation of stringers.

Figure 6:
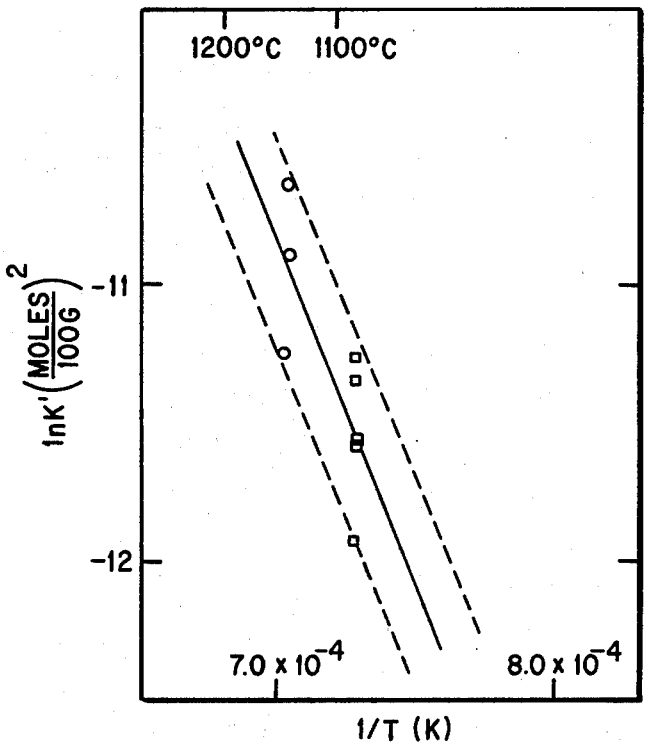
FIG. 6 is a graph of the natural logarithm of K′ for titanium modified 316 and 321 stainless steels vs. 1/T.

FIG. 6 is a similar graph of ln K'[Ti]×[C] for the stainless steel system having the following composition by weight 13–15% Cr, 13–15% Ni, 0 to 1.1% Mo, 0–1% Si, and 0.025 to 0.05% C, 0.15 to 0.3% T, (6×C) and the remainder Fe. According to the procedures described herein, this minimum single phase temperature can be determined knowing the titanium and carbon compositions of an alloy. The equation of the solid straight line in FIG. 6 is $$\ln K'\left(\frac{\text{moles}}{100\text{g}}\right)^2 = 5.8275 - \frac{2.3869\times10^4}{T(K)}. \quad (2)$$

By annealing at a temperature above the single phase temperature obtained from Equation (2) (preferably above the safe single phase temperature indicated by the dotted line left of the solid diagonal line) first for a time sufficient to dissolve the carbides and thereafter for an additional time to prevent the reprecipitation of segregated carbides, an improved stainless steel results. Upon subsequent aging or thermomechanical treatment, carbides will precipitate to provide an alloy having a uniformly distributed carbide phase. It is seen that the process of this invention can be readily applied by workers in the art to a variety of alloy systems prone to the reprecipitation of segregated carbides such as stringers without departing from the spirit and scope of this invention.

What is claimed is:

1. A method for preventing the formation of segregated carbide precipitates in an alloy susceptible to the reprecipitation of segregated metal carbides, said alloy comprising by weight 13–15% Mo, 6–8% Cr, 0–2% Fe, 0–2% Mn, 1.8–2.2% Ti, 0.05–0.08% C and the balance Ni, said method comprising the steps of:

(a) first annealing said alloy having a segregated carbide phase at a temperature above the minimum single phase temperature for a time sufficient to dissolve said metal carbides and provide a single phase alloy; and (b) further annealing said single phase alloy at a temperature above the minimum single phase temperature for a time, at least three-quarters hour, to prevent the precipitation of segregated metal carbides upon subsequent aging or thermomechanical treatment, said minimum single phase temperature being above 1205° C.

2. The method of claim 1 in which said alloy has a composition by weight comprising about 15% Mo, 7% Cr, 0.5% Mn, 1.8–2.2% Ti, 0.05–0.08% C and the balance Ni.

3. The alloy prepared by the method of claim 1 and having a precipitated metal carbide phase uniformly dispersed throughout the alloy.

4. The method of claim 1 in which said annealing steps (a) and (b) are performed at a temperature above 1280° C.

5. A method for preventing the formation of segregated carbide precipitates in an alloy susceptible to the reprecipitation of segregated metal carbides, said alloy comprising by weight 12–16% Mo, 5–9% Cr, 0–3% Fe, 0–3% Mn, 1–2% Ti, 0.02–0.08% C and the balance Ni, said method comprising the steps of:

(a) first annealing said alloy having a segregated carbide phase at a temperature above the minimum single phase temperature for a time sufficient to dissolve said metal carbides and provide a single phase alloy; and (b) further annealing said single phase alloy at a temperature above the minimum single phase temperature for a time, at least three-quarters hour, to prevent the precipitation of segregated metal carbides upon subsequent aging or thermomechanical treatment, said minimum single phase temperature being above 1177° C.

6. The alloy prepared by the method of claim 5 and having a precipitated metal carbide phase uniformly dispersed throughout the alloy.

* * * * *